United States Patent [19]

Makipirtti et al.

[11] 4,236,700

[45] Dec. 2, 1980

[54] DEVICE FOR SUSPENSION SMELTING OF FINELY-DIVIDED OXIDE AND/OR SULFIDE ORES AND CONCENTRATES

[75] Inventors: Simo A. I. Makipirtti, Nakkila; Jussi J. Kayhko, Pori, both of Finland

[73] Assignee: Outokumpu Oy, Outokumpu, Finland

[21] Appl. No.: 951,063

[22] Filed: Oct. 13, 1978

Related U.S. Application Data

[60] Division of Ser. No. 753,575, Dec. 22, 1976, Pat. No. 4,139,371, which is a continuation-in-part of Ser. No. 588,602, Jun. 20, 1975, abandoned.

[51] Int. Cl.[3] ..... F27B 3/24

[52] U.S. Cl. ..... 266/161; 75/72; 75/82; 75/92

[58] Field of Search ..... 266/161, 162; 75/26, 75/23, 92, 72–75, 82

[56] References Cited

U.S. PATENT DOCUMENTS 3,674,463 7/1972 Yannopoulos ..... 75/74

*Primary Examiner*—M. J. Andrews

*Attorney, Agent, or Firm*—Brooks, Haidt, Haffner & Delahunty

[57] ABSTRACT

A process for the suspension smelting of finely divided oxide and/or sulfide ores and concentrates, especially iron-rich copper and/or nickel concentrates, in which a suspension of a finely-divided feed mixture in preheated air and/or oxygen is fed downwards, at the reaction temperature or above it, first into a suspension oxidation zone for the oxidation and partial smelting of the raw material in suspension, and therafter into a suspension reduction zone under the suspension oxidation zone for a partial sulfidization of the oxidized raw material, where the suspension flow is finally caused to change its flow direction perpendicularly sidewards so that most of the raw material present in the suspension flow impinges against the surface of the accumulated melt in a melt reaction zone below the suspension reduction zone, wherein an oxidizing gas is injected into the matte phase of the melt reaction zone in order to produce raw metal from the valuable metals present in the melt and the remaining suspension flow and the gases from the melt reaction zone are directed into a rising-flow zone, where the flow is possibly after-sulfidized and cooled and the solid materials are separated from the rising-flow zone flue gases in order to return them to the suspension oxidation zone.

2 Claims, 6 Drawing Figures

(D – D)

(E - E)

(1-B)

Stability areas of Cu-S-O, Fe-S-O- and Fe-S-O-SiO-systems as a function of sulfur and oxygen pressure
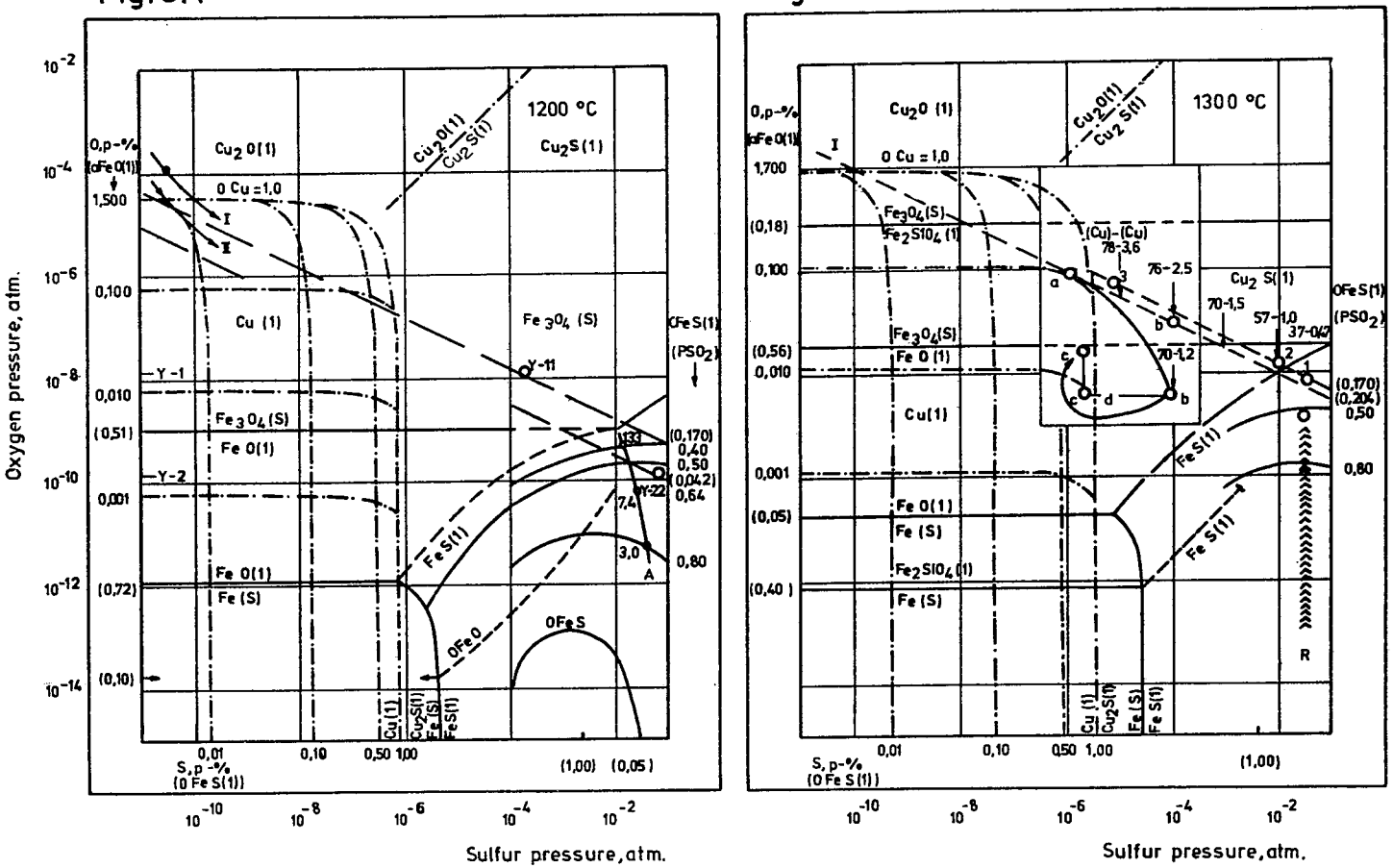

DEVICE FOR SUSPENSION SMELTING OF FINELY-DIVIDED OXIDE AND/OR SULFIDE ORES AND CONCENTRATESCROSS REFERENCE TO RELATED APPLICATIONS

This is a division of application Ser. No. 753,575, filed Dec. 22, 1976, now U.S. Pat. No. 4,139,371 which application is a continuation-in-part of our prior abandonded application Ser. No. 588,602 filed on June 20, 1975, now abandonded and entitled "Process and Device for Suspension Smelting of Finely-Divided Oxide and/or Sulfide Ores and Concentrates, especially Copper and/or Nickel Concentrates Rich in Iron".

BACKGROUND OF THE INVENTION

The present invention relates to a vertical suspension smelting process and device which makes it possible to process finely-divided copper- and/or nickel-bearing concentrates into metal and reject matte. The object of the invention is to provide a process by which especially sulfidic and/or oxidic concentrates rich in iron can be processed advantageously in terms of both technology and economy.

In recent years the object in developing copper processes has been to perform the various stages of the process, i.e., smelting, conversion and slag-purification processes, in one and the same unit, whereby a lessening of the environmental hazards caused by the sulfur-bearing reaction gases is achieved in addition to certain economic and technological advantages.

When refining ferriferous concentrates, the common problem in all processes is the great atmospheric sensitivity of the slag phases produced in the process. The use of gases with a high oxygen potential, necessary in the oxidation processes, causes a sharp increase in the ferric iron and copper contents of the slag phases. In such a case a sufficient lowering of the valuable-metal contents of the slag phases respectively require an effective reduction process. The processes developed for manufacturing copper differ from each other mainly in the manner in which the various stages of the process are combined. The known basic processes, which have been continuously developed, can be classified into flash furnace, direct conversion, and suspension processes. It is mainly suspension processes that are discussed in this connection. In the process according to U.S. Pat. No. 3,687,656, a horizontal cyclone oxidation system (known from, for example: L. M. Rafalovich, V. L. Russo: Tsvetnye Metally, No. 9, 1964, pp. 30–39) has been linked to a chamber which has been provided with one or more partitions at times reaching the melt in the furnace tank and which operates according to the principle of communicating vessels. When the matte surface in the surface tank has risen sufficiently owing to the processing, the slag phase separated into the chamber following the first chamber is reduced by iron sulfide spraying, whereby the obtained valuable-metal matte settles in the tank. The obtained reject slag is removed from the system and the exposed sulfide matte is blasted into metal in the same or (depending on the iron content of the matte) the following chamber (surface blast). After the discharge of the raw metal the matte-slag phase accumulated in the first chamber during the partial processes spreads into the furnace tank below the partitions, and the process continues in a manner corresponding to the initial situation. The discharge of the reaction gases from the system takes place through the upper part of the chambers.

In the process according to U.S. Pat. No. 3,555,164, a vertical cyclone oxidation system is used. It has been linked to a smelting chamber provided with a dam wall against the cyclone (in horizontal systems, the wall opposite the dam wall is against the cyclone: Rafelovich and U.S. Pat. No. 3,687,656). One end of the smelting chamber has been linked to an electric heating furnace by means of a gas partition extending into the melt. The reaction gases are fed into the purification process from the other end of the smelting chamber. Between the smelting chamber and the electric heating furnace and on the side of the electric heating furnace there is an accumulation container for separating the matte from the slag. The metal vapors obtained in the sulfur-free atmosphere in the electric heating furnace during the course of the slag reduction are condensed into raw metal. Judging from the patent specification it is possible to produce copper, according to the process, directly from, for example, chalcocite concentrates. However, the system might be suitable for ferriferous copper and nickel concentrates only when these valuable metals are recovered in the form of sulfide matte. In such a case condensing raw metal (Zn, Cd, Hg, etc.), sulfide matte and waste slag are obtained from the electric heating furnace. As examples of complete suspension processes, in which the discharge of the suspension mainly occurs against the melt surface of the furnace part (in cyclone smelting, already in the cyclone device), we can mention the horizontal oxidation processes producing low-grade sulfide mattes and, when provided with a periodic iron sulfide spraying also waste slags (e.g., U.S. Pat. No. 2,668,107), and the vertical suspension systems which produce high-grade mattes and metals. The first vertical suspension process implemented on a technological scale is the one according to U.S. Pat. No. 2,506,557. The process is used to produce sulfide mattes poor in valuable metals and those rich in valuable metals, as well as raw metals. The continuous contact between the sulfide matte and the slag phase according to the process prerequires, even in equilibrium, relatively high valuable-metal concentrations in the slag phase, and therefore, according to the patent specification, a reverberatory or an electric furnace has been linked to the system for the purpose of slag reduction. It should be mentioned that, according to the original process, metallic copper and slag which requires only a slight reduction (a function of the Fe, Co, and Ni contents of the concentrate) can be produced directly on an industrial scale from, for example, chalcocite concentrates. The basic process has been developed to a great extent during the past couple of decades. In another method, a process for sulfidizing the slag and the flying dust in the lower furnace and the rising shaft has been developed for the reduction, into an equilibrium, of the slag phase obtained in producing high-grade sulfide mattes, in which case, by regulating the degree of reduction of the gas phase, either a partial or complete separation of elemental sulfur form the gas phase is achieved. In the process according to U.S. Pat. No. 3,754,891 a post-oxidation reduction process for the sulfide concentrate in the reaction shaft has been developed. The process makes it possible to produce iron-poor nickel matte from nickel-poor, highly ferriferous sulfide concentrates. The process is based on a selective resulfidization, in the furnace tank, of most of the nickel oxide produced by oxidizing the concentrate, for example, before it combines into olivine in the slag phase. Two new processes should also be mentioned among the applications of the vertical suspension smelting process.

In the process according to U.S. Pat. No. 3,674,463, the object has obviously been to improve the flash smelting process (U.S. Pat. No. 2,506,557) in order to make it suitable for iron-rich sulfide concentrates. The process is discussed in more detail than is usual because of both its general nature and the close links between it and the flash smelting processes. A conventional flash smelting furnace is used in the process. The oxidation of the suspension is also performed in a conventional flash smelting reaction shaft. The ratio between oxygen and the feed sulfides has been regulated so that 35–75% of the copper present in the feed mixture is converted into metal. Deviating from the conventional flash smelting process, copper concentrate is fed into the lower part of the reaction shaft. The purpose is to produce a very low oxygen pressure in the lower part of the reaction shaft, that is, less than $10^{-5}$ mm Hg ($1.3\times0.0^{-8}$ atm) close to the slag surface. According to the patent specification, the sprayed additional concentrate serves as a protection against a high partial pressure of oxygen, which would otherwise cause magnetite formation. In the process, both the sulfide conversion and the control of the ferric iron in the product of oxidation are thus performed in suspension.

When evaluating the new process on the basis of the theory and practice of flash smelting, it can be noted that with the conventional height of the reaction shaft, temperature of the suspension, and flow rates of the flash smelting system, a direct conversion into metal of the sulfide in suspension is not possible. It is true that a small part of the copper is always recovered in a metallic form from the reaction shaft, but this metal is produced as a result of the reactions of the shaft product impining against the shaft wall. Most of the metal phase in the flash smelting system is not produced until in the lower-furnace reactions (e.g., partial oxidation of chalcocite: $2\ Cu_2O(l)+Cu_2S(l)\rightleftarrows 6Cu(l)+SO_2(g)$. In the production of high-grade copper mattes the metal phase at the bottom of the furnace tank is produced when the superoxidized shaft product metallizes copper sulfide in the furnace tank, and the metal phase segregates into a separate phase owing to the sulfide-metal-melt solubility gap. Most of the metallic copper present in the solid slags of high-grade sulfide mattes originates in the reactions taking place in the slag at the solidification stage (e.g., the decomposition reaction of the remanent melt and wüstite: $3FeO(s)+Cu_2O(s)\rightleftarrows Fe_3O_4(s)+Cu(s)$).

A few observations on the reactions in the suspension according to the description of the process of the above patent, with reference to FIG. 3: The stability ranges of the systems Cu-S-O and Fe-S-O as functions of the partial pressures of sulfur and oxygen in the atmosphere, at 1200° C., calculated on the basis of known thermodynamic functions, are shown in FIG. 3A. The description of the process gives values $P_{O2}=1.32\times10^{-8}-1.32\times10^{-10}$ atm as the limits of the oxygen pressure in the gas phase after the spraying of concentrate. These pressure limits are indicated by indices Y-1 and Y-2 in FIG. 3-A. Respectively, the gas phase compositions corresponding to the oxygen pressures have been calculated from the (incomplete) material balance in the description. They are indicated in the drawing by indices Y-11 and Y-12 (i.e. $P_{SO2}=0.17$ and 0.04 atm) According to the diagram, each composition is approached mainly in the direction of arrows I and II. In case I, copper oxide (possibly metallic) and copper sulfide are stable in the oxidation path when the oxygen pressure lowers. Magnetite produced primarily under a high oxygen pressure (air oxidation) is stable all the time. Thus, the suspension product obtained in an equilibrium is a mixture of magnetite and molten copper sulfide. In case II, the course of the oxidation reactions is analogous, but the final equilibrium (Y-22) prerequires the presence of the product mixture molten copper sulfide and iron sulfide in the suspension. It should be noted in this connection that the oxygen pressure of the system cannot be reduced alone, e.g., along a low sulfur isobar from the range of solid magnetite to the wüstite range, since the sulfur dioxide present in the gas phase is known to be reduced extremely rapidly and at the same time the partial pressure of the sulfur of the gas phase increases respectively. Thereby, magnetite is both reduced and sulfidized. In an atmosphere completely devoid of sulfur, the lowering of the oxygen pressure in the suspension is known to lead to a magnetic reduction rate determined by a very slow diffusion of solids, which is not of the same order as the sulfidizing rate in a gas phase containing elemental sulfur. A rapid sulfidization is due to the effect of the molten phase (Fe-S-O) produced on the magnetite surface and detaching from it, in which case the reduction and the sulfidization occur on an almost pure oxide surface (the product of sulfidization "departs").

On the basis of the flash smelting theory and practice, it is not easy in the process according to the patent description to prevent a rapid sulfidization of the copper or copper oxide in the suspension in the gas atmosphere prerequiring a stable sulfide salt, as set forth in the description. It should also be mentioned that the conversion, according to the description, of a high-grade sulfide matte in suspension in a separate zone (shaft) is very difficult. A partial oxidation of the sulfide matte in suspension and an oxide)sulfide conversion taking place in the furnace tank on the other hand, do produce results (known from, for example, U.S. Pat. No. 2,209,331).

The recent development of continuous-working suspension systems producing metal from concentrate is illustrated by the system described in U.S. Pat. No 3,460,817. In this system, the oxidation of iron-free copper matte from concentrate is performed in a conventional flash-smelting shaft. The copper rate and the slag phase are separated in the furnace tank. The copper matte accumulates in the space below the shaft and flows from there, under the partition extending into the matte phase, into the conversion part of the furnace system (Arutz siphon). In the conversion space the iron-free sulfide matte is blasted into metal by means of oxygen (air) by either surface or tuyere blasting. Opposite the conversion part in relation to the reaction shaft there is the slag-treatment zone (reverberatory). The slag reduction is performed with molten iron sulfide, the produced poorgrade copper matte flowing against the slag coming from under the reaction shaft. Molten iron sulfide is produced by oxidizing pyritic or other sulfide concentrates in suspension with a limited air quantity in a second reaction shaft close to the slag discharge end of the furnace system (known from U.S. Pat. No. 3,306,708). In the system according to the description, great attention has thus been accorded to the treatment of the slag phase.

In FIG. 3-A there is a curve A which indicates the position, in the stability field, of the iron sulfide mattes obtained in the suspension smelting of pyrite (on an industrial scale). Under conventional industrial conditions the operation takes place with low gas-phase oxygen pressures $P_{O2}=10^{-9}-10^{-10}$ atm as the atmosphere consists essentially of sulfur. In the operation pyrite is only smelted, not oxidized and thus the oxygen partial pressure remaining low. According to the diagram, the iron sulfide activity in the mattes is very low ($a_{FeS}$=0-.4–0.6) owing to the effect of the dissolved oxygen. For low copper concentrations in the waste slags, large quantities of reducing sulfide must be used in the reduction (matte-slag separation). This results in a considerable increase in the waste slag quantity. It must be noted, however, that the system according to the patent description can obviously be used for producing metallic copper continuously.

The technological level of reverberatories and conversion furnaces producing metal directly from concentrate will also be discussed. The recent development of reverberatory processes is well illustrated by the Worcra smelting process and its applications, of which U.S. Pat. Nos. 3,326,671 and 3,527,449 can be mentioned as examples. In the process according to U.S. Pat. No. 3,527,449, which uses an improved reverberatory, metal (Cu) is produced in one unit directly from concentrate. The process includes smelting, conversion and slag-removing zones, the first one being situated in the center of the furnace. The conversion is performed with air pipes. The lowering of the sulfur concentration in the obtained product to a value corresponding to raw metal can be performed by converting it with an Arutz siphon in a furnace tank part separate from the matte and slag phases. The slag is purified by a pyrite wash in the slag-removal zone.

The processes according to Canadian Pat. No. 758,020 and Pat. Application No. 104,111 can be mentioned as examples of the present level of continuous conversion processes. A modified Peirce-Smith-type converter is used for the conversion. The blasting of the concentrate into raw metal is performed in one or more zones. In addition to raw metal, a slag phase rich in valuable metals is obtained from the system (4.5–12% Cu), and this slag phase is treated outside the converter by known processes (reverberatory, froth flotation, etc.).

SUMMARY OF THE INVENTION

In the process according to the present invention, copper concentrate is processed in one unit into raw metal and waste slag. The process is performed in a modified flash smelting furnace (FSF). The principle of the new process is a combined oxidation, reduction and oxidation of the concentrate and as a result the degree of oxidation of the produced primary slag phase and thereby both its ferric iron and its valuable-metal contents are low. Thereby the reduction of the slag into waste slag requires little treatment and a processing which does not increase the quantities of slag, and it is thereby advantageous both technologically and economically. The recovery of valuable metals from the slag phase, which is the primary problem in the conventional processes, becomes a secondary problem in the new process, considering the total process.

In conventional processes comprising three separate processing units, sulfide matte is first produced from the concentrate, generally by using a reverberatory or an electric or flash-smelting furnace. Depending on the grade of the matte, a slag phase is obtained which is already waste slag as such or which must be treated in a suitable furnace unit or by various concentration processes for the separation of the valuable metals. The obtained sulfide matte is blasted into metal in a converter, and the slag phase rich in valuable metals is reduced either separately or together with the slag of the primary smelting. This complicated operation results in many different intermediate products, loads which circulate in the production system, losses of thermal and other energy, and gas pollution of the environment. In recent years, new processes have been developed side by side with the conventional processes, the object having been to reduce the number of processing units and naturally to improve the conventional processing methods. The reduction of the slag phase with a high valuable metal content, obtained by the new continuous conversion processes which produce metal directly from concentrate has usually been arranged in connection with some conventional basic smelting unit (reverberatory). In processes comprising one unit, the prereduction of the slag is generally performed with a low-grade slag matte flowing against the slag phase form the slag reduction zone. The final reduction of the slag phase and the production of slag matte are performed using iron sulfide produced by a partially oxidizing smelting. In such a case, a self-regulating reduction of slag is inefficient owing to the low activity of iron sulfide. The main part of the "reduction process" obviously takes place as a liquid-liquid extraction, whereby the quantity of the final slag phase increases greatly.

In the process according to the present invention, the primary slag reduction process after the oxidation of the concentrate, and thereby also the secondary slag reduction leading to waste slag, is controlled.

When sulfide concentrates are oxidized in suspension, the unstable iron sulfides oxidize first (usually to a high degree of oxidation), and the iron present in chalcopyrite and pentlandite oxidizes partially only thereafter. Thereby the oxidation of the actual valuable-metal sulfides (e.g., nickel) is not selective in regard to iron. When only part of the iron present in the concentrate is oxidized, the activity of the iron sulfide in the sulfide solution remains relatively high. Since in such a case the quantity of ferric iron produced in the oxidation is also low, the reduction reactions have time to take place in the furnace tank. The products of the processing are the conventional sulfide matte and slag phases, poor in valuable metals and in a state of equilibrium. When the degree of oxidation of the concentrate rises, the activity of the iron sulfide in the sulfide melt of the product of oxidation lowers rapidly, and simultaneously the concentrations of ferric iron and valuable metals in the product increase. In such a case the reduction reactions do not occur to such a degree as to produce an equilibrium before the reduction reactions become too slow in terms of technology, owing to the reaction surface diminished by the matte-slag separation. Thus, an iron-poor sulfide matte and a slag phase with low valuable-metal and ferric iron contents in equilibrium with the matte cannot be produced simultaneously by self-regulating slag reduction. The concentrate must usually be superoxidized in order to produce iron-poor matte, and the ferric iron and valuable-metal contents in the product of oxidation must be reduced and/or sulfidized by a regulated reduction system. In the process according to the invention the reduction is controlled by producing active iron sulfide in the system. This sulfide is produced by feeding crude oil in a predetermined manner into the oxidized suspension flow, whereby a sufficient quantity of iron oxide in suspension is reduced and sulfidized, the necessary sulfur being reduced from the sulfur dioxide present in the oxidation gas phase. When the reduced product of oxidation arrives in the reaction zone of the furnace tank, this active iron sulfide still reduces a sufficient part of the solid magnetite present in the oxidation product and simultaneously selectively sulfidizes the valuable-metal oxides even before their silicates are formed. When the quantity of iron silicate slag increases, the need for reduction is insignificant and the still unreacted iron sulfide, together with other sulfides, passes down through the slag phase.

The converesion of sulfide salt by conventional technology is a process lacking equilibrium. When the quantity of sulfur in the melt decreases, the efficiency of the oxygen in the oxidizing gas begins to lower. At the same time, part of the valuable metals (Ni, Co, Cu) are oxidized from the melt, thereby forming a semi-solid waste slag whichis left in the converter and limits its capacity.

In the process according to the invention, the metallization of the sulfides is performed below the slag-reaction zone which is below the reaction shaft in the furnace tank, whereby the sulfide oxidation zone and the zone for reducing, in zones, of the shaft oxidation product above it constitute an uninterrupted metallization zone. Thereby the iron sulfide from the reduction of the shaft oxidation product selectively sulfidizes the valuable-metal oxides not in equilibrium, produced at the metal (matte)-slag boundary during the metallization, and reduces the available oxygen in the metallizing gases. The gas phase is reduced to approach an oxygen pressure corresponding to the total slag, in which case, under the effect of the oxidizing gases, the slag phase and the valuable-metal sulfides continuously passing down through it cannot oxidize and increase the need for slag reduction and thereby the load consisting of slag matte circulating in the system.

In the process according to the invention a new injection method has been adopted for the reason that the metallization of sulfides occurs mainly within the diffusional kinetic range. In a preferred embodiment of the invention oxidizing-gas velocities close to that of sound are used, so that a decimal decrease in the size of the bubbles formed by the oxidizing gases in the melt and thereby a respective increase in the number of the bubbles per volume unit is achievable along with a good mixing efficiency. Thereby, a remarkable shortening of the diffusion distances and simultaneously a substantial increase in the oxygen efficiency have been achieved. These factors make processing possible even with a small thickness of the sulfide matte layer.

Thus, the use of the process according to the invention achieves a very low primary degree of oxidation for the slag emerging from the metallization zone and a respective low valuable-metal content in it. The need for slag reduction is thereby sharply decreased and the reduction can be easily performed continuously, e.g., alumino-, silico- or electrothermally. Naturally, nickel or copper-nickel concentrates can also be metallized economically by the new process.

The process has a considerable advantage in comparison with conventional ones in that it makes it possible to treat the sulfurbearing reaction gases together in a limited space, and thereby it decreases gas pollution of the environment.

In the process according to the invention, metallic copper is produced continuously from ferriferous concentrates. The object of the process is to perform the metallization of the concentrate in such a way that the concentrations of both ferric iron and copper in the obtained primary slag phase are as low as possible, in which case the reduction of this slag phase into waste slag is advantageous both technologically and economically. According to the process, this result is achieved by combining the controlled suspension oxidation of concentrate using zone reduction and the injection oxidation of the melt bath consisting of sulfides so as to take place in the same zone. In the controlled reduction reactions of the valuable-metal oxides, as well as of the ferric iron and the gas phase, a reducing agent prepared from the reaction products themselves by means of a fossil fuel is used.

DESCRIPTION OF THE PREFERRED EMBODIMENTS

Figure 1:
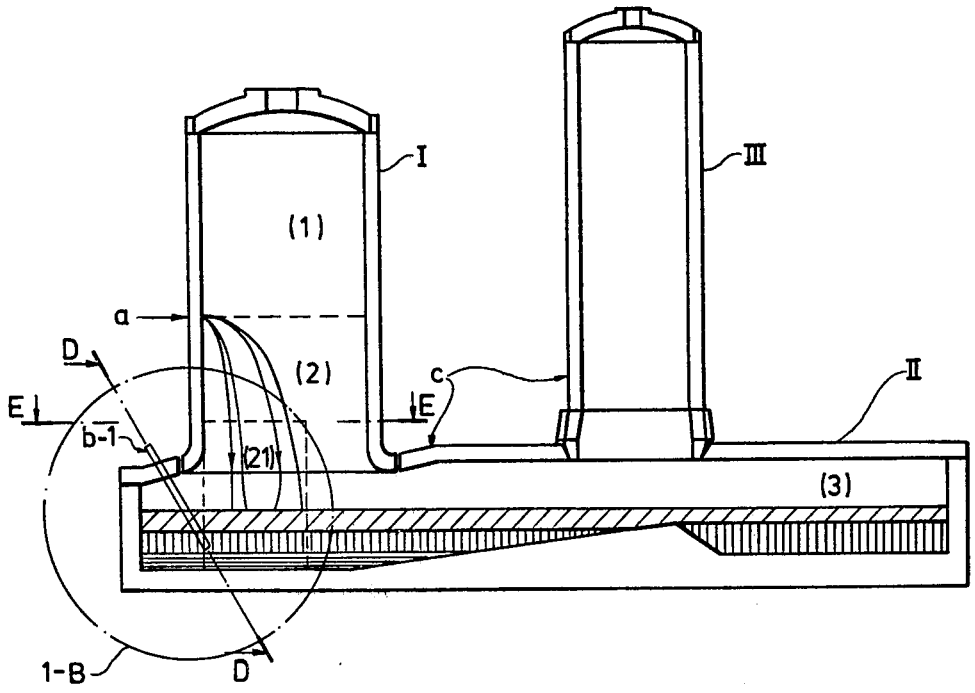
FIG. 1 depicts a cross section of a furnace used in the process according to the invention.
Figure 2:
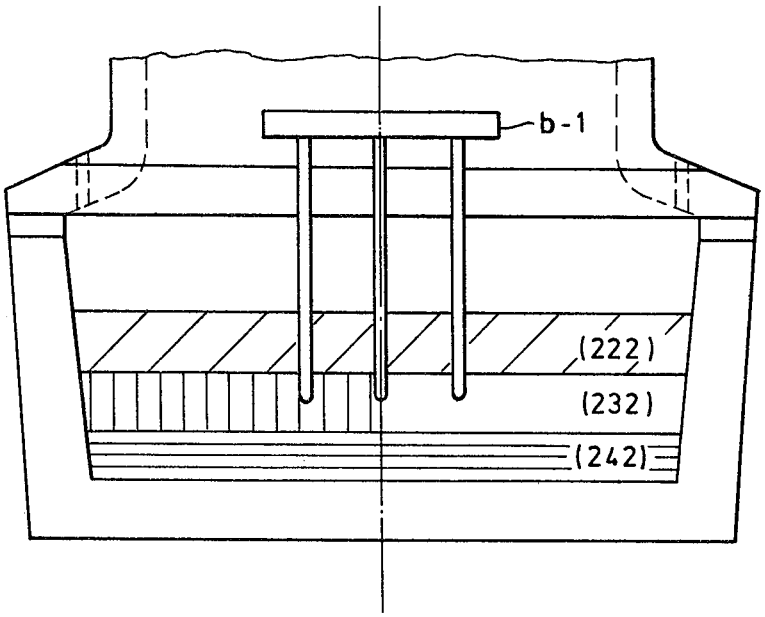
FIG. 2 illustrates a cross-section along line D—D in FIG. 1.

The process according to the invention can be carried out in, for example, a furnace system depicted in FIG. 1. The furnace consists of a reaction shaft (I), a lower furnace (II) and a rising shaft (III). When observed functionally, the furnace system is divided into the zones indicated in FIG. 1, that is, (1) suspension oxidation, (2) metallization, and (3) slag reduction, of which the metallization zone can still be divided into a suspension reduction zone and, below it, a melt reaction zone, which may be divided into an upper slag reaction zone, intermediate matte reaction zone and lower metal reaction zone.

FIGS. 5-A and 5-B depict the stability ranges of the components possible in the process, as functions of the partial pressures of the sulfur and the oxygen in the gas phase at temperatures 1200° C. (FIG. 5-A) and 1300° C. (FIG. 5-B), calculated from known thermodynamic values.

FIG. 5-A includes the systems Cu-S-O and Fe-S-O and thereby illustrates the equilibriums in, for example, a material distribution in suspension. FIG. 5-B also includes the system Fe-S-O-$SiO_2$, whereby the equilibriums in a molten bath can be observed. The calculation concerning the silicate system is based on a silicic acid concentration of 32.5% $SiO_2$. The positions of some sulfide mattes obtained by flash smelting, and iron silicates in a dynamic equilibrium with the former, have been placed in the stability field of FIG. 5-B. ([Cu]-(Cu) indicates the copper concentrations in the sulfide matte and the slag). The values have been obtained by allowing a product produced by oxidizing the feed sulfide with air to react freely in the furnace tank, i.e. without using any zone reduction to control the reaction. The positions of iron matte, obtained in a slag-free suspension smelting of pyrite, have been placed in FIG. 5-A (curve A: next to the points there is indicated the oxygen concentration of the sulfide matte in percentages by weight).

The material quantity and anaylsis values corresponding to the processing example under discussion are numbered in Table 1.

The material balance of the various components referred to herein after is given in the appended Table 1.

The first stage of the new process is the suspension oxidation of the feed mixture in the oxidation zone 1 of the reaction shaft I. Thereby the iron in the sulfides in the feed mixture is oxidized to correspond to the shaft oxidation product required in the production of high-grade copper sulfide matte (75–77% Cu). In the lower furnace II the iron sulfide in the sulfide part of this shaft product reduces part of the ferric iron present in the shaft product. Thereby the iron and sulfur concentrations in the sulfide matte produced from the sulfide part of the shaft product become lower than those in the said sulfide part. From the results in Table 1 it can be noted that the produced slag phase contains great quantities of both ferric iron and valuable metal. It is clear that the reduction of the obtained slag phase requires considerable operations. In the process according to the invention the object is to maintain the need for slag reduction small even primarily. For this reason the oxidized shaft product is not allowed to react to produce matte and slag but is fast treated in the reduction zone 2 to obtain a better composition for the reactions in the melt reaction zone.

Several separate partial processes occur in the metallization zone, and the products obtained from the zone as a joint result of these reactions are metallic copper and a slag phase poor in valuable metals which is fed further to the slag reduction zone.

Figure 4:
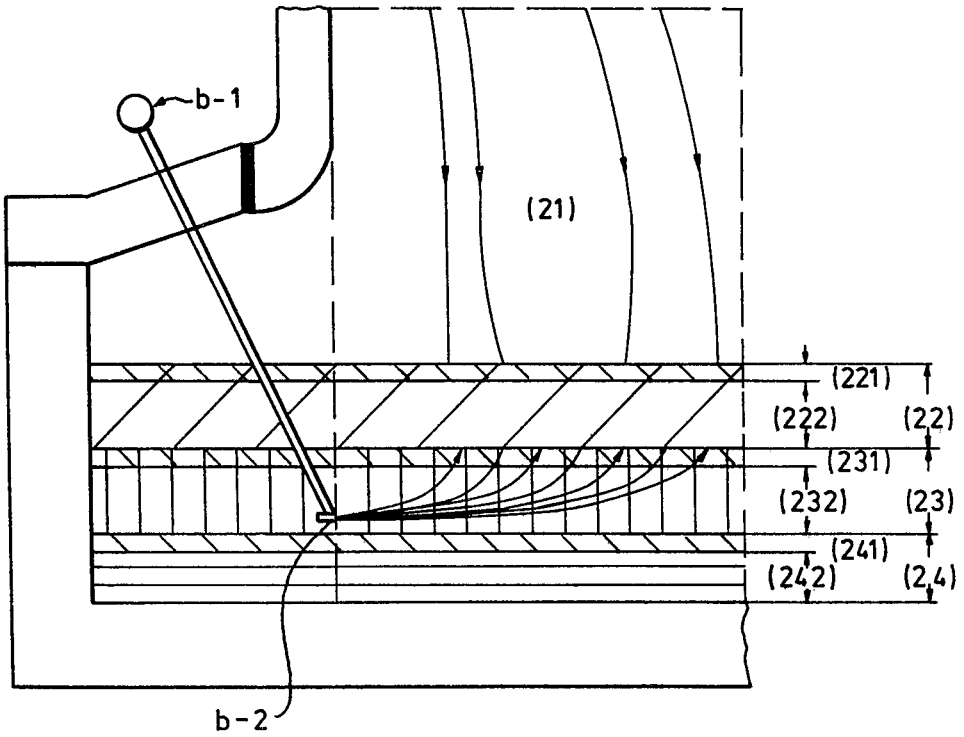
FIG. 4 shows an enlarged partial view 1B of FIG. 1, and FIGS. 5-A and 5-B depict the stability ranges of the systems Cu-S-O, Fe-S-O and Fe-S-O-$SiO_2$ as functions of the pressures of sulfur and oxygen.

The diagram of FIG. 4 shows the partial zones of the metallization zone. The principal zones are the reduction zone 21, the slag reaction zone 22, the matte reaction zone 23 and the metal reaction zone 24. The principal zones are still divided into more or less clearly outlined sub-zones or transition layers (here 221, 231 and 241). The operation of these zones is discussed below.

The sulfide part of the shaft product in suspension, emerging from the oxidation zone 1, has a very even average composition since the iron left in it mainly originates in chalcopyrite, which oxidizes last. The activity of the iron sulfide in the sulfide mixture (oxing to its low concentration) is very low (sulfide: 76% Cu; $a_{FeS}$ 0.04) so that in spite of the high velocity of the lower-furnace reactions the degree of reduction of the ferric iron in the oxide part of the shaft product remains low. During the delay period determined by the matte-slag separation, the ferric iron of the shaft product will not have time to become reduced to correspond to a low-grade slag phase, the reducing iron sulfide being in a solution and thereby having a low activity. A self-regulating reduction system always produces an iron-poor matte obtainable only by a superoxidation of the concentrate and respectively a slag rich in ferric iron and valuable metals. The reduction system must therefore be controlled, and this is possible by, for example, increasing the activity of the iron sulfide present in the shaft product.

In the present process the activity of the iron sulfide is increased by using zone reduction (21, FIG. 4). In the reduction light petroleum or light oil is sprayed with horizontal pipes (two or more, suitably distributed in the periphery of the shaft; a, FIG. 1) into the superoxidized suspension emerging almost vertically from the oxidation zone; this light petroleum or oil forms a highly reducing zone in the reaction shaft I. The degree of reduction in the zone 21 increases towards its central axis. Part of the sulfur dioxide present in the gas phase in the oxidation zone 1 is reduced in the zone 21 and the sulfur sulfidizes some of the suspended magnetite and wüstite which are being reduced. Thus, conditions corresponding to an almost oxygen-free and pure iron sulfide with an activity close to one are obtained in the central parts of the zone (X-ray-microanalyzer observations).

The shaft product containing active iron sulfide impinges against the melt surface in the lower furnace II, and the reduction of the ferric iron begins. In the diagram of FIG. 4, a transition zone 221 is indicated in the surface part of the slag zone 22. A shaft product mixture, in which the sulfide phases are in molten state and the oxide phases (magnetite, silicic acid) mostly in solid state, "rains" continuously into this zone. The sulfide part 7, calculated as oxygen-free in the discussion, is only approx. 26% by vol. of the shaft product. The large quantity of finely-divided solid material in the shaft product sharply increases the viscosity of the transition zone 221 and thereby decreases the velocity of the settling of the sulfide drops (which is stimulated according to Stokes' law) through the produced slag phase. The long delay period of the sulfides in the layer also makes possible a longer delay period for the reduction reactions compared with a completed slag melt 222.

The slag reactions occurring in the upper part of the transition zone, where there is solid magnetite, can be described as follows, for example:

$$FeS(l)+3Fe_3O_4(s)\rightleftarrows 10FeO(s,l)+So_2(g) \quad (1)$$

$$10FeO(s,l)+5SiO_2(s)\rightleftarrows 5Fe_2SiO_4(l) \quad (2)$$

When the molten phases increase as a result of the reactions, the viscosity of the system lowers and the sulfide phases pass at an increasing velocity down through the produced molten slag (i.e., a matte-slag separation occurs). Some reduction of the ferric iron also occurs in the melt as a function of the delay period of the settling of the sulfides. In such a case the reactions can be described as follows, for example:

$$FeS(l)+6FeO_{1.5}(FeO,\ SiO_2)\ (l)\rightleftarrows 7FeO(FeO_{1.5},\ SiO_2)\ (l)+SO_2(g) \quad (3)$$

It can be observed from the reactions in the transition zone that when magnetite is reduced in solid state, the equilibrium is mainly determined by the activity of the iron sulfide, since the activity of iron oxide, in powers of 10, which prevents the formation of an advantageous equilibrium, is lowered by olivine reactions. The same applies to ferric iron in solution, but in addition to the activity of iron sulfide the reduction is affected by a low $a_{FeO_{1.5}}$(diffusion transport).

The velocity of the slag reactions in the zone 22 in an industrial as well as a pilot system can be simulated with the reaction velocity equation $$d[SO_2]/dt=k[O]^2[s],$$

in which k is the reaction velocity constant and [s] are the so-called kinetic concentrations of oxygen and sulfur in the reaction system. According to the measurements the value of the velocity constant is $k=0.72\times10^{-2}C^{-3}S^{-1}$. The delay period in the zone is a function of the solid-material reaction in the system. The occurrences in the metallization zone are observed with reference to the stability diagram (FIG. 5-B).

The position of the sulfide matte produced in the lower furnace II, corresponding to the shaft product, is indicated by a in the diagram. Point a corresponds to an oxygen pressure of $P_{O2}=8.4\times10^{-7}$ atm) in the slag and a sulfur dioxide pressure of ($P_{SO2}=0.17$ atm) in the gas phase. At 1300° C. the equilibrium constant of the reaction equation (3), above, is k=357.9. The activities of the ferrous and ferric oxides in the slag phase (melt treated as regular solutions) are $a_{FeO}=0.218$ and $a_{FeO1.5}=0.175$. By placing the values in the reaction equation, the obtained sulfur dioxide pressure is $P_{SO2}=16.5$ atm (the value obtained from the reaction equation (1): $k=5.65\times10^{-4}$ is $P_{SO2}=89$ atm). Thus, the slag reduction is far from being in equilibrium. The reduction have obviously slowed down owing to the diminishing of the reaction surface due to the matte-slag separation. The degree of oxidation of the shaft product is also too high, and thus the activity of the iron sulfide in its sulfide part 3 has been too low even prior to the reduction reactions.

In a dynamic equilibrium the position of the equilibrium system corresponding to point a, obtained in a flash smelting system under advantageous conditions, is indicated in the stability field by b' ([Cu]−(Cu): 76−2.6). The results of observation a and b' both correspond to results obtained by self-regulating reduction mechanisms. The activity values of the slag and matte phases corresponding to point b' at 1300° C. are as follows: $P_{O2}=9.57\times10^{-8}$; $a_{FeO}=0.274$; $a_{FeO1.5}=0.134$, and $a_{FeS}=3.97\times10^{-2}$. The value $P_{SO2}=0.71$ atm is obtained from the reaction equation for the reaction pressure. Depending on the furnace conditions, some reactions may still occur, but a dynamic equilibrium is obvioulsy close. It should particularly be noted in this connection that it is mainly an equilibrium between the matte and the molten slag that is concerned in the system. The gas phase above the slag melt is of a very small practical importance owing to the weak chemical effect (neutral) of these gases and to the small reaction surface (compared with, for example, a system in suspension). The prerequisite for the slag reaction 3 (in a technological system) is thus a $SO_2$ pressure sufficient for both the formation of bubles and for the removal of the reaction product ($SO_2$(g)) from the system. It should also be noted that the values obtained from the calculations are only directive since the available thermodynamic values include a certain margin of error (experimental values).

When unalloyed, highly active iron sulfide participates in the ferric iron reduction in the slag zone 22, the position of the matte-slag equilibrium moves from point a to point b. Point b corresponds to the matte and the slag according to Table 1. The iron sulfide activity in the reducing sulfide varies in the reduction system between $a_{FeS}=1.0$ and $a_{FeS}=4.7\times10^{-2}$. The former value corresponds to pure iron sulfide and the latter to the activity of alloyed iron sulfide in the matte phase 8. The activity values of the slag melt are $P_{O2}=4.44\times10^{-9}$ atm, $a_{FeO}=0.303$ and $a_{FeO1.5}=0.068$. The pressure of reduction reaction 3 is thereby within $P_{SO2}=0.0$-07–0.148 atm.

The pressure values are at the lower boundary of the operation range. The reason for this is obviously the inexactness of the calculation values used and the treatment of the slag phase as a physically and chemically homogeneous system (which it is not). Let it be mentioned as an example that when monosilicate of iron (45.5% $SiO_2$) forms as a phase preceding orthosilicate (29.5% $SiO_2$) (conventional order) in some part of the slag reduction zone and when the $SiO_2$ concentration in the system is, for example, 40% $SiO_2$, the respective reaction pressure limits are high, i.e., $P_{SO2}=1.28$–0.06 atm. The limits of the activity values of the iron sulfide obtained in zone reduction (arrow R: $a_{FeS}=0.95$–0.50) have been drawn as a diagram in the stability field (FIG. 5-B). The end point of the arrow represents the average composition of the gas phase after sulfidization (% by vol.) at 1300° C., i.e., 1.93 $H_2$; 14.96 $H_2O$; 0.79 $H_2S$; 4.16 CO; 10.87 $CO_2$; 0.08 COS; 3.82 $SO_2$; 2.33 $S_2$ and 61.05 $N_2$+Ar.

A second important process in the metallization zone in addition to zone reduction is the removal of the sulfur present in the sulfide phase obtained by controlled sulfide slag reactions and thereby the production of raw metal. This is performed by oxidizing sulfides with ordinary or oxygen-enriched air.

The conventional method for converting sulfide mattes is blasting an oxidizer through melt (e.g., Peirce-Smith) or the surface blast method (e.g., Kaldo), which is rarer. When metal is produced in one unit, the oxidation of the sulfur present in the sulfide is usually performed by surface blasting, even if tuyeres or suspension processes were used for the production of iron-free sulfide. In the process according to the present invention, the oxidation is performed by injecting oxygen horisontally into the sulfide melt or at the boundary of the sulfide-metal layer. According to investigations, in the oxidation of the copper sulfide and copper present in the melt, the operation takes place within the diffusional kinetic range. The reaction velocity is thereby mainly determined by the velocity of the oxidizer in the melt surface. When injection is used, the diffusion distance is a function of the size of the bubbles formed by the oxidizer in the melt and of the number of bubbles formed per one volume unit. In the metallization according to the present process, the bubble size is preferably decreased by raising, close to the velocity of sound, the velocity of the oxidizing gas at the nozzles. It should be noted that raising the nozzle velocity in a conventional conversion system causes an increase in the gas bubble size and thereby a lowering in the conversion efficiency. When, however, the nozzle velocity increases sufficiently, a very sharp (decimal) decreases in the bubble size suddenly occurs within velocity ranges close to the velocity of sound. A suitable operation range (a function of the nozzle technology, etc.) has been observed at an oxidizing gas velocity of approx. 300 m/s. High nozzle velocities make it possible to perform the sulfide oxidation with a sufficient oxidation potential even with thin sulfide-layer thicknesses. The high velocity of the gases also produces a strong mixture efficiency. The slag phase above the sulfide phase is highly stable physically (high viscosity) in spite of the mixing effect so that the sulfide slag separation is not disturbed. The quantity of reaction gases produced in the sulfide oxidation is low (12.1% in the example) compared with the total gas quantity in the system.

It can be seen in the diagram of FIG. 4 that the sulfide oxidation is performed immediately below the slag reduction zone. It has been observed in practice and in experiments that, at the final stage of the sulfur blasting, the efficiency of the oxidizer usually decreases and free oxygen is left in the gas phase. Often it is for this reason that the conversion of iron-free copper sulfide is performed in a separate part, usually separated from the slag phase by means of a partition (e.g., U.S. Pat. Nos. 3,460,817 and 3,687,656), in which case the converting gases cannot oxidize the iron present in the slag phase into ferric form (and at the same time oxidize the valuable metal content in the sulfide). In the present process these problems have been eliminated by causing active iron sulfide (both independent and alloyed), which has been reduced by zone reduction past the reduction need of primary slag, to pass down all the time through the slag phase above the oxidation zone. The iron sulfide converts in the transition layer 231 the valuable-metal oxides not in equilibrium (formally, for example: $2CuO_{\frac{1}{2}}(l)+FeS(l)\rightleftarrows FeO\ (FeO_{1.5},\ SiO_2)\ (l)+2CuS_{\frac{1}{2}}(l)$) and reduces the oxidizing gases to such a degree that they cannot oxidize the slag phase. The reduction sulfide of the total metallization is included in the shaft product and in its sulfide part in the example according to Table 1.

The sulfide proceeding to oxidation also contains, as an overflow (or discharge) from the slag reduction zone, the slag sulfide with a low concentration. The average copper concentration in the sulfide mixture is then 73% Cu. The copper concentration in a sulfide phase (intermediate matte) in contact with raw copper is approx. 79.8% Cu. The composition of the air used for the oxidation was 30.0% $O_2$ and 0.6% $H_2O$. According to the pipe sample taken from the oxidation gases, their sulfur dioxide concentration was 26 % by vol. $SO_2$, whereby the sulfur pressure calculated from the material balance was 3.34 % by vol. $S_2$. Thus the oxygen pressure at 1300° C. corresonded to $P_{O2}=8\times10^{-9}$ atm. The oxygen pressure in the metallization slag proceeding to slag pruification was $P_{O2}=3.74\times10^{-9}$ atm. i.e., lower than that in the slag phase 14. According to the stability analysis in FIG. 5-B, a move takes place from an equilibrium corresponding to point b to point c during the oxidation of the sulfides; the respective raw copper analysis is given in Table 1. The position of raw copper in equilibrium would correspond to point c' in the diagram (i.e., 0.01 % O) and those of the intermediate matte and the metallization slag would respectively be closed to this point c' (d). The suitability of the values obtained under practical conditions is, however, excellent. The activity values of the oxidation slag are $a_{FeO}=0.316$ and $a_{FeO1.5}=0.068$. The iron sulfide activity in the oxidizing sulfide varies within the following limits: 1.0 (zone sulfide), $a_{FeS}=0.50$ (slag sulfide), and $a_{FeS}=4.9\times10^{-3}$ (intermediate matte). The following values are obtained from the reduction reaction equation (3) for the corresponding sulfur dioxide pressures: $P_{SO2}=0.11$; 0.05 and $5.3\times10^{-4}$ atm, which are of the correct order. The position of the gas phase after the sulfide oxidation is indicated by 1 in the stability field. Points 2 and 3 indicate the positions of the gas phase in cases in which the reduction of iron sulfide is not performed and the oxygen efficiency in the metallization is low, i.e., 82.5 % (the respective copper and ferric iron concentrations in the slag are: point 2—1.7 and 5.5 %; point 3—3.9 and 10.8%).

In order to recover the valuable metals, of the slag phase obtained from the metallization zone the slag phase may be reduced. The concentrations of both ferric iron and copper in the slag phase are lowered, even primarily. This is very advantageous in terms of the total process since the quantity of slag matte returning from the metallization zone is thereby low. Quite conventional processes can be used for the slag reduction (flash or electric heat furnaces: U.S. Pat. No. 2,506,557/1950; silico- or alumothermia, etc.).

In the case according to the example (Table 1), iron sulfide, coke and electric heat were used for the slag reduction. The copper concentration selected for the slag matte 18 was 35 % Cu. It is clear that higher-grade mattes than this can be used, in which case, however, the ferric iron concentration in the corresponding slag must be lowered to a lower value than that given for the waste slag. In continuous slag reduction it is easy to operate with a relatively high waste slag oxidation degree since it is usually difficult to perform the reduction in an equilibrium. A slag matte conventionally produced is strongly metallized in spite of a high ferric iron concentration in the slag. When the need for slag reduction is decreased it is natural that the method by which the reduction is performed is not of the same importance in terms of the total process as in the processes of old technology.

The object of the description of the new process has been to clarify only its essential features. It is clear that the process can also be used for producing only high-grade copper and/or nickel matte. The production example illustrates the production of converter matte by the new process. As known, a solubility gap between metal and sulfide in molten state does not appear in the Ni-S and Ni-Cu-S systems within the composition ranges concerned in this connection. Nickel matte can, however, be easily metallized at conventional temperatures (1000°-1500° C.). The sulfur concentration in the sulfides can in such a case be lowered to (or below) a value which corresponds to, for example, the concentration of copper, as a sulfide, in the melt. The metallized sulfide matte is then in equilibrium directly with the slag phase, whereby the valuable-metal content in the slags is high. When copper concentrate is processed by the new method, equilibrium conditions between metal and slag can also be used, but in such a case leaving the intermediate matte out of the system increases the need for slag reduction. A very low oxygen potential in the waste slag and a slag matte relatively rich in valuable metals have been used in the production example of the nickel process, whereby the result obtained has been very advantageous valuable-metal concentrates in the waste slag.

The furnace system according to the invention is an almost conventional flash-smelting furnace. The height and the diameter of the furnace reaction shaft used for experimental purposes were 9.4 m and 3.8 1 m. The corresponding dimensions of the rising shaft were 9.0 m and 2.8 m. The total area of the lower surface was 80 $m^2$, of which approx. 30 $m^2$ was slag reduction area. For realizing the zone reduction, three oil-feeding pipes a had been placed at the shaft at the level of approx. 6 m from the reaction shaft vault. The pipes were at an angle of 120° in relation to each other at the central axis of the shaft so that one of the pipes was in the direction of the central axis of the lower furnace on the side of the rising shaft. Between the reaction shaft and the rising shaft and at the lower end of the rising shaft there were pipes c for feeding oil for the reduction of the furnace gases. The masonry work of the lower furnace corresponded to the diagram in FIG. 1. The oxidation means b operating in the experiments at high nozzle velocities was in the part between the smelting-furnace end and the reaction shaft.

Figure 3:
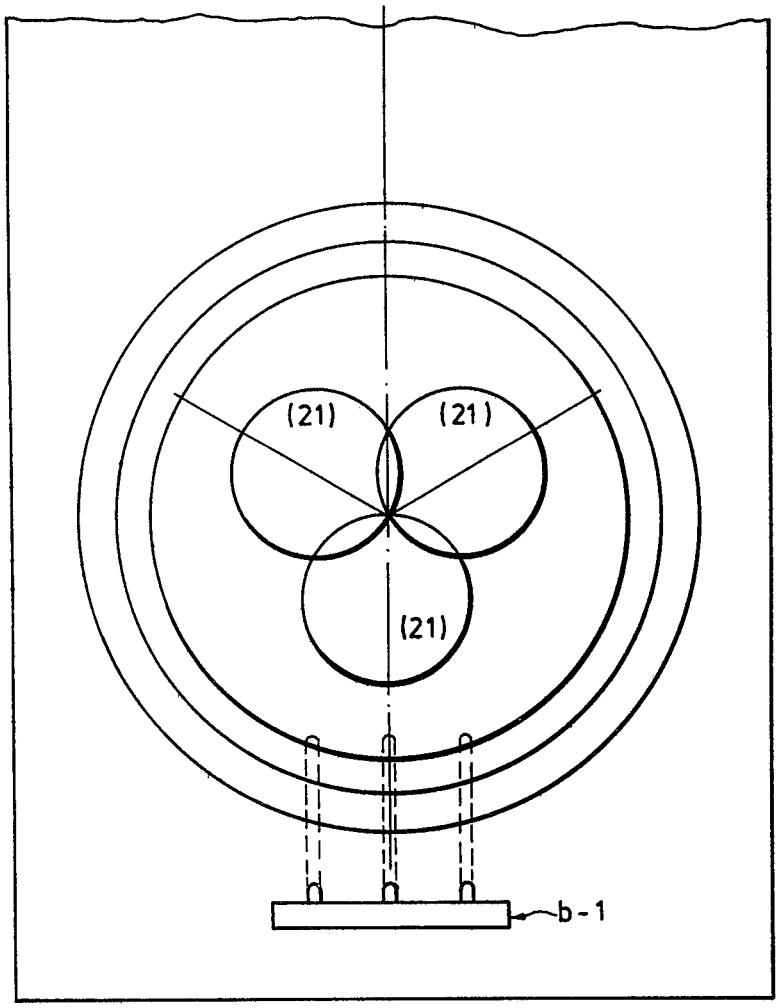
FIG. 3 illustrates a section taken along line E—E in FIG. 1.

As appears from FIGS. 1–4 the oxidating agent is injected into the matte reaction zone 23 by means of three inclined lances b-1 extending through the furnace wall from above the melt surface. The lances b-1 are so arranged that they form three partially overlapping reduction zones 21 as shown in FIG. 3.

The nozzle b-2 at the outlet end of the lances b-1 are projecting horizontally in order to blow the oxidating agent substantially parallel with the matte reaction zone 23 as shown by the arrows in FIG. 4.

EXAMPLES

A process according to the invention and conventional process for producing metallic copper from ferriferous sulfide concentrates is described below with reference to example. The production of metallized nickel copper matte from nickel-poor sulfide concentrate according to the invention si described thereafter.

The compositions of the concentrates and additives in the processes corresponding to the examples are given in the following table. In the description, the quantities and concentrations of solids and molten materials are expressed in kilograms and percentages by weight and the respective values in gas phases are given in normal cubic meters and percentages by volume (unless otherwise indicated).

Copper process

Concentrate:

20.60 Cu; 0.12 Ni; 0.26 Co; 0.99 Zn; 34.10 Fe; 34.60 S; 7.50 $SiO_2$; 0.25 CaO; 0.93 MgO; 0.12 $Al_2O_3$

Sand:

9.74 $SiO_2$; 0.46 CaO; 0.22 MgO; 4.70 $Al_2O_3$; 1.0 $Fe_2O_3$

Nickel process

Concentrate:

6.14 Ni; 0.65 Cu; 0.19 Co; 41.30 Fe; 29.60 S; 0.33 C; 0.07 H; 11.70 $SiO_2$; 1.34 CaO; 3.65 MgO; 1.60 $Al_2O_3$; 0.99 BaO, etc.

Leaching residue:

18.80 Ni; 42.10 Cu; 0.24 Co; 1.10 Fe; 14.60 S; 4.40 $SiO_2$; 0.17 CaO; 0.40 MgO; 6.35 BaO, etc.

Sand:

89.00 $SiO_2$; 0.50 CaO; 0.35 MgO; 5.00 $Al_2O_3$; 2.43 $Fe_2O_3$

Fuels:

Iron sulfides:

50.45 Fe; 45.37 S; 4.17 $SiO_2$, etc. and
58.43 Fe; 37.08 S; 4.50 $SiO_2$, etc.

Coke:

88.0 C; 84.4 $C_{fix}$; 1.10 H; 0.75 S; 9.80 $SiO_2$, etc.

Heavy oil:

85.0 C; 11.8 H; 2.5 S; 0.1 $H_2O$

Light petroleum:

84.0 C; 16.0 H

The aim was to maintain the furnace unit in thermal equilibrium during the processing and the conditions constant even in other respects. When the testing period of the process was changed, the time required for bringing the system into equilibrium was approx. 60 hours.

EXAMPLE 1

Example 1 illustrates the production of metallic copper by the process according to the new invention, on an industrial scale. The material and heat balances corresponding to the example and the Nernst's distributions of the product phases are given in Tables 2, 21 and 5.

The operation of the reaction shaft was autogenic in the suspension oxidation zone, whereby the composition of the feed air was 24.85 $O_2$; 0.60 $H_2O$; 74.55 $N_2+Ar$. The $SO_2$ concentration in the gases after the oxidation was 18.5%.

It can be seen in Table 2 that the obtained slag phase contained large quantities of ferric iron (16.5 $Fe_3O_4$) and copper and very little sulfur. When the slag solidifies, copper is separated in a metallic form and simultaneously the magnetite concentration in the slag obviously increases to over 20% $Fe_3O_4$.

Product $Kt=3.30\times10^{-3}C^{-2}$ is obtained from the material balance and the reaction velocity equation, nad, taking into consideration the reaction velocity value, $K=0.72\times10^{-3}C^{-2}S^{-1}$ the apparent delay period obtained from this product for the slag reduction reaction is 4.6 s. Judging from the delay period, the feed rate of the furnace (19.3 tn/h) is far from the peak rate. The delay period of the reaction gases in the reaction shaft (1350° C.) is 4.0 s on the average.

It is clear that the reduction of the obtained slag phase (the slag being very good in terms of production) would require a great deal of energy and a large furnace unit. For this reason the shaft product of the oxidation zone is not allowed to react as such but is directed to the metallization zone for processing.

Light petroleum was fed vertically into the product flow oxidized in the metallization zone (here: 137 kg/h, nozzle pressure 10 kp/cm$^2$), whereby part of the sulfur dioxide present in the oxidation gases was reduced and part of the oxide phase in the shaft product was reduced and sulfidized. The suspension volume in the zone was approx. 1950 Nm$^3$. The average analysis obtained form the material balance for the gas phase in the zone (1300° C.) is: 1.42 $H_2$; 10.98 $H_2O$; 0.66 $H_2S$; 3.03 CO; 7.92 $CO_2$; 0.06 COS; 2.96 $S_2$; 4.31 $SO_2$ and 68.97 $N_2+Ar$. The oxygen pressure of the gas phase is then $P_{O2}=1.40\times10^{-9}$ atm.

Owing to the zone reduction, the quantity of the sulfide part of the shaft product increased, owing to the sulfidized iron oxide (etc.), to the value indicated in the result table. If the sulfide and oxide parts of the obtained shaft product reacted freely in the lower furnace, the results would be highgrade sulfide matte approx. 3.89 tn and slag approx. 11.18 tn. The analysis estimate of the slag that would be obtained is given in parentheses in Table 2. The copper and ferric iron concentrations in the total slag are slightly increased under the effect of the metallizing exidation of sulfides.

Slag matte in an amount of approx. 12%, calculated from the total sulfide quantity, flows (here) to the metallization zone. The metallization of the sulfides was performed with oxygenenriched air (30.0 $O_2$ and 0.6 $H_2O$). The gas phase (as well as valuable-metal oxides, not in equilibrium) obtained in the oxidation is reduced to an oxygen pressure of $o_{O2}=3.03\times10^{-8}$ atm under the effect of sulfide obtained by zone reduction. The quantity of the obtained gas phase was approx. 2050 Nm$^3$ and its analysis 0.02 $H_2$; 0.60 $H_2O$; 0.26 $S_2$; 27.50 $SO_2$; 71.62 $N_2+Ar$.

The significant improvement of the copper distribution between the products obtained by zone reduction as compared with the products of suspension oxidation can be seen in the Nernst's distribution value (Table 5; increase in the H-values of copper and nickel: Cu 26-46, Ni 18-26). The H-values of the intermediate matte and slag remain advantageous in the metallization. In spite of the low copper concentration in the slag matte, the H-values are very high in the products of slag reduction.

The slag phase obtained from the metallization of the shaft product was reduced in the slag reduction zone by adding to it coke, iron sulfide and heat energy. 35% Cu was taken as the copper concentration of slag matte corresponding to waste slag. The oxidation degree of the waste slag is relatively high ($P_{O2}=2.16\times10^{-9}$ atm), its copper concentration being low, however, (0.4% Cu). The rate of the reduction gas phase was low (90 $Nm^3/h$), and its analysis was 0.6 $H_2$; 18.5 CO; 59.9 $CO_2$; 6.2 $S_2$, and 9.6 $SO_2$.

The already partially pre-reduced gases emerging from the metallization and slag-reduction zone are reduced in the rising shaft, in order to recover the elemental sulfur, to correspond to the catalysis ratio $(H_2+H_2S+CO+COS)/2SO_2=1$. Owing to the reduction, the temperature of the gas phase lowers to approx 1250° C. and its volume increases by approx. 18% owing to the fuel feed (1.47 tn/h gasoline). The oxygen pressure and analysis of the gas phase are $P_{O2}=2.96\times10^{-10}$ atm and 1.57 $H_2$; 10.49 $H_2O$; 1.27 $H_2S$; 3.33 CO; 8.12 $CO_2$; 0.12 COS; 5.75 $S_2$; 3.15 $SO_2$; 66.19 $N_2+Ar$. The recovery of elemental sulfur is 95.2% of the sulfur feed (waste slag and metal 4.0%, catalyses losses 0.8%).

EXAMPLE 2

Example 2 illustrates the processing of a feed mixture corresponding to the previous example, by a conventional method which comprises the flash smelting, conversion and slag reduction operations taking place in separate units. The example mainly illustrates the differences between the new process according to the invention and the conventional process. The material and heat balances of the conventional process and the Nernst's distributions of the product phases are given in Tables 3, 31 and 5.

According to Table 3, the feed mixture has been oxidized slightly more than in the previous example (the difference between the copper concentrations in the sulfide mattes is approx. 4.5% Cu). The copper concentration in the slag obtained from the smelting is for this reason high. Similar copper-rich slags can usually be expected when iron-free mattes are produced by flash smelting without any special measures. It should be noted that in systems with less equilibrium than flash smelting (e.g., continuous conversion of concentrates), the valuable-metal concentrations in the obtained slags are still higher. A low copper concentration in slag matte, together with a high copper concentration in the slag, increases the amount of iron sulfide to be used. It should also be noted that the gas phase was not reduced, and therefore the flying dust obtained from the furnace system was sulfated in the waste heat tank (flying dust b, Table 3). Great changes are not, however, to be expected in the total energy balance (coke, iron sulfide, electric energy) ofthe process under discussion even if lower copper concentrations in the flash-smelting matte and slag were used in the example.

The example is, however, suitable for a comparison between the processes since the concentrate quantities, as well as the quantities of metallic copper produced, are equal in both cases. The differences calculated from the material and heat balances of Examples 1 and 2 are in the following table, in which the differences between the respective balance values of the old and the new methods are compared with the balance values of the new method.

| | |
|---|---|
| Total energy | +181% |
| Electric energy | + 53% |
| Coke quantity | +240% |
| Slag matte quantity | +443% |
| Slag quantity | + 21% |
| Gas volume | + 27% |

It can be said that in very many respects the process according to the new invention is both technologically and economically better than a conventional process.

EXAMPLE 3

In Example 3, metallized nickel-copper matte is produced by the new process. The first stage of the conventional process for producing this converter matte consists of the refining of nickel concentrate, by the FS-process, into a sulfide matte with a concentration of approx. 50% Cu+Ni. In the second stage this sulfide matte and the slag matte obtained by an electric-furnace reduction of the FS-slag are converted. In the conversion, the iron of the matte mixture is first slagged, and in a sulfar blast thereafter the sulfur concentration in the iron-free sulfide matte is lowered to the level of converter matte. The converter slag rich in valuable metals is reduced in an electric furnace together with the FS-slag.

According to the new process, the production of converter matte is performed in one unit. The material and heat balances of a process corresponding to the example and the valuable-metal distributions of the phases are given in Table 4, 41, and 5.

The process according to Example 3 is fully analogous to the processing of copper concentrate in Example 1. It can be noted from Table 4, however, that the selectivity of the oxidation of the nickel concentrate (air 26.0 $O_2$ and 0.74 $H_2O$) is very poor. Even though the sulfide matte obtained from the shaft product of the oxidation zone still contains Fe 3.8% (Ni: 41.8%), the nickel concentration in the slag phase is already 4.7% Ni. The yield of nickel in the sulfide matte is only 29.2% of the nickel of the feed (flying dust is not taken into consideration). It is clear that there is no point in reducing the thus obtained slag phase in an electric furnace.

The zone reduction of the products of oxidation is performed in the metallization zone using light petroleum. According to estimations, the reduced shaft product would yield, as a result of matte-slag reactions, the matte and slag quantities and analyses given in parentheses in Table 4. It can be observed that the quantity of sulfide matte has doubled without any change in its iron concentration, and at the same time the nickel concentration in the slag phase has lowered to approx. 1.2% Ni. The volume of the reduction zone was approx. 12% of the suspension volume. The temperature of the zone was approx. 1350° C. and the oxygen pressure of the gases $P_{O2}=3.8\times10^{-9}$ atm. After the sulfidization of the shaft product the composition of the gas phase was: 2.18 $H_2$; 15.46 $H_2O$; 0.41 $H_2S$; 4.73 CO; 10.52 $CO_2$; 0.04

COS; 0.76 $S_2$; 2.54 $SO_2$; 63.34 $N_2$+Ar. According to Table 5, the Nernst's distribution of nickel has grown over tenfold under the effect of the zone reduction. The metallization of the zone-reduced shaft product and the metallized sulfide matte obtained from the slag reduction is performed with oxygen-enriched air (47.78 $O_2$ and 0.46 $H_2O$). A small part of the nickel and copper present in the sulfides is oxidized during the metallization, The efficiency of oxygen in the converting was approx. 95%. The sulfide produced in excess in the zone reduction causes at the phase boundary a selective resulfidization of the said nickel and copper oxides and a reduction of the reaction gases containing free oxygen. The analysis of the gas phase withdrawn from the slag surface (1300° C., $P_{O2}=1.39\times10^{-8}$) was as follows; 0.02 $H_2$; 0.47 $H_2O$; 2.80 $S_2$; 41.63 $SO_2$; 55.07 $N_2$+Ar. The slag phase obtained from the metallization zone was reduced electrothermally to a very low degree of oxidation by adding coke and pyrite. The results obtained were a small quantity of metallized, high-grade (Ni+Co+Cu 50%) slag matte and a waste slag very poor in valuable metals (Table 4). The composition of the gas phase produced in the reduction (1300° C.; $P_{O2}=1.46\times10^{-11}$ atm) was as follows: 2.50 $H_2$; 2.12 $H_2O$; 1.18 $H_2S$; 66.51 CO; 17.65 $CO_2$; 2.19 COS; 7.24 $S_2$. According to Table 5, the distribution values of nickel and cobalt have risen in the slag reduction to approx. tenfold compared with the values of the previous example.

The combined gas phase obtained by the process was not reduced in the rising shaft but its oxidable components were oxidized in the waste heat tank using sooting air, and the gases were directed to a sulfuric acid production plant. Part of the sulfur quantity present in the converter matte, bound to the leaching residue of the nickel electrolysis, was returned to the process. The recovery of sulfur into the gas phase was 95.4%, calculated from the sulfur quantity in the concentrate feed.

TABLE 1.

Method in accordance with the invention. Material balance.

| Material balance component | No. | Amount kg | Analysis, weight % Cu | Fe | $Fe^{+3}$ | S | O | $SiO_2$ |
|---|---|---|---|---|---|---|---|---|
| Suspension oxidation | | | | | | | | |
| Feed mixture | 1 | 1116.5 | 18.45 | 30.54 | — | 30.19 | — | 20.82 |
| Shaft product | 2 | 964.6 | 21.36 | 35.35 | 21.27 | 6.70 | 12.55 | 24.08 |
| sulfide part | 3 | 243.6 | 73.99 | 4.66 | — | 21.35 | — | — |
| Flash smelting matte | 4 | 236.8 | 76.12 | 3.00 | 0.70 | 20.33 | 0.40 | 0.15 |
| Flash smelting slag | 5 | 702.7 | 3.67 | 47.52 | 10.24 | 0.20 | 15.27 | 33.00 |
| Slag reduction | | | | | | | | |
| Iron sulfide | 16 | 24.2 | — | 58.43 | — | 37.08 | — | (4.50) |
| Coke | 17 | 1.2 | — | — | — | — | — | — |
| Slag matte | 18 | 17.0 | 35.00 | 38.44 | 2.33 | 25.26 | 1.00 | 0.30 |
| Waste slag | 19 | 700.7 | 0.40 | 50.62 | 2.28 | 1.60 | 14.08 | 33.30 |
| **Balance component** | **No.** | **Amount kg** | **Analysis, weight % Cu** | **Fe** | **$Fe^{+3}$** | **S** | **O** | **$SiO_2$** |
| Metallization | | | | | | | | |
| Zone reduction | | | | | | | | |
| Shaft product -A- | 6 | 964.8 | 21.27 | 35.21 | 19.95 | 7.80 | 11.73 | 23.98 |
| sulfide part | 7 | 309.5 | 59.07 | 16.54 | — | 24.40 | — | — |
| Flash smelting matte | 8 | 261.5 | 75.60 | 3.40 | 0.63 | 20.49 | 0.36 | 0.15 |
| Flash smelting slag | 9 | 675.5 | 1.23 | 49.17 | 4.04 | 0.92 | 14.36 | 34.33 |
| Shaft product-B- | 10 | 971.2 | 21.21 | 35.11 | 18.88 | 8.65 | 11.12 | 23.91 |
| sulfide part | 11 | 332.7 | 54.94 | 19.82 | — | 25.24 | — | — |
| Sulfide oxidation | | | | | | | | |
| Matte mixture | 12 | 278.5 | 73.13 | 5.54 | 0.70 | 20.78 | 0.40 | 0.16 |
| Raw metal | 13 | 205.7 | 98.78 | 0.25 | — | 0.95 | 0.02 | — |
| Slag phase | 14 | 695.9 | 1.26 | 49.86 | 4.13 | 0.93 | 14.57 | 33.38 |
| Intermediate matte | 15 | — | 79.80 | 0.40 | — | 19.40 | 0.30 | 0.10 |

TABLE 2.

Method in accordance with the invention. Material balance.

| Balance component | Amount kg | Analysis, weight % Cu | Fe | $Fe^{+3}$ | Me | S | O | $SiO_2$ | $O_x$ |
|---|---|---|---|---|---|---|---|---|---|
| Shaft oxidation process | | | | | | | | | |
| Feed mixture | 1284.0 | 17.33 | 28.83 | 1.47 | 1.09 | 28.52 | 0.14 | 21.13 | 1.98 |
| Shaft sulfide | 290.3 | 63.49 | 12.24 | — | 1.13 | 23.15 | — | — | — |
| Matte | 246.3 | 74.84 | 3.25 | 0.70 | 1.33 | 20.03 | 0.40 | — | — |
| Slag | 757.6 | 2.87 | 44.19 | 7.94 | 0.90 | 0.31 | 14.23 | 33.64 | 3.11 |
| Metallization process | | | | | | | | | |
| Shaft sulfide | 315.1 | 59.10 | 15.90 | — | 1.04 | 23.95 | — | — | — |
| (Flash smelting slag) | 745.0 | 1.63 | 44.88 | 5.19 | 0.90 | 0.85 | 13.61 | 34.20 | 3.16 |
| Raw copper | 210.0 | 96.67 | 0.25 | — | 1.46 | — | 0.01 | — | — |
| Slag | 781.5 | 1.74 | 46.01 | 5.48 | 1.01 | 0.88 | 14.00 | 32.61 | 3.01 |
| Fly dust | 83.0 | 19.85 | 33.04 | 20.64 | 4.67 | 7.27 | — | 19.94 | 2.27 |
| Fly dust (b) | 88.0 | 18.73 | 31.16 | — | 4.40 | 23.01 | 1.19 | 18.81 | 2.14 |
| Intermediate matte | — | 78.05 | 0.50 | — | 1.39 | 19.27 | 0.30 | — | — |
| Slag reduction process | | | | | | | | | |
| Matte | 35.0 | 30.07 | 49.53 | — | 2.60 | 14.50 | 1.80 | 0.50 | — |

TABLE 2.-continued

| Method in accordance with the invention. Material balance. | | | | | | | | | |
|---|---|---|---|---|---|---|---|---|---|
| | Amount | Analysis, weight % | | | | | | | |
| Balance component | kg | Cu | Fe | $Fe^{+3}$ | Me | S | O | $SiO_2$ | $O_x$ |
| Waste slag | 760.4 | 0.40 | 46.80 | 3.34 | 0.93 | 1.60 | 13.37 | 33.51 | 3.10 |

TABLE 21.

| Method in accordance with the invention. Heat balance. | | | | | | |
|---|---|---|---|---|---|---|
| | Reaction shaft: oxidation balance | | | Reaction shaft: reduction balance | | |
| Heat balance component | Material amount ton/$Nm^3$ | Temperature °C. | Temperature Mcal | Material amount ton/$Nm^3$ | Temperature °C. | Temperature Mcal |
| In | | | | | | |
| Feed mixture | 19.26 | 25 | 15740 | | | |
| Shaft product | | | | 16.73 | 1350 | 5710 |
| Gas phase | | | | 16580 | 1350 | 8450 |
| Gasoline | | | | 0.14 | 25 | 1500 |
| Air | 17980 | 25 | — | | | |
| In together | | | 15740 | | | 15660 |
| Out | | | | | | |
| Shaft product | 16.73 | 1350 | 5710 | 16.81 | 1300 | 6140 |
| Gas phase | 16580 | 1350 | 8450 | 16870 | 1300 | 8980 |
| Heat losses | | | 1600 | | | 700 |
| Out together | | | 15760 | | | 15720 |
| | Lower furnace balance | | | Rising shaft balance | | |
| Heat balance component | Material ton/$Nm^3$ | Temperature °C. | Temperature Meal | Material ton/$Nm^3$ | Temperature °C. | Temperature Meal |
| In | | | | | | |
| Shaft product | 16.81 | 1300 | 6140 | 1.25 | 1300 | 450 |
| Gas phase | 16870 | 1300 | 8980 | 19180 | 1300 | 10340 |
| Slag matte | 0.53 | 1250 | 530 | | | |
| Pyrite | 0.41 | 25 | 510 | | | |
| Coke | 0.05 | 25 | 300 | | | |
| Gasoline | | | | 1.47 | 25 | 16420 |
| Added energy | | | 1680 | | | |
| Air | 2110 | 25 | — | | | |
| In together | | | 18140 | | | 27210 |
| Out | | | | | | |
| Raw copper | 3.15 | 1250 | 1670 | | | |
| Waste slag | 11.41 | 1300 | 4490 | | | |
| Fly dust | 1.25 | 1300 | 450 | 1.32 | 1250 | 1340 |
| Gas phase | 19180 | 1300 | 10340 | 22470 | 1250 | 25240 |
| Heat losses | | | 1200 | | | 600 |
| Out together | | | 18150 | | | 27183 |

TABLE 3.

| Common practice. Material balance | | | | | | | | | |
|---|---|---|---|---|---|---|---|---|---|
| | Amount | Analysis, weight - % | | | | | | | |
| Balance component | kg | Cu | Fe | $Fe^{+3}$ | Me | S | O | $SiO_2$ | $O_x$ |
| Flush smelting process | | | | | | | | | |
| Feed mixture | 1296.5 | 17.28 | 28.21 | — | 1.36 | 27.26 | 1.87 | 21.33 | 1.97 |
| Shaft product | 1107.3 | 20.24 | 33.03 | 20.65 | 1.59 | 4.81 | 12.84 | 24.97 | 2.31 |
| Matte - I | 194.0 | 79.30 | 0.42 | — | 0.47 | 19.20 | 0.40 | 0.21 | — |
| Slag - I | 810.0 | 6.44 | 42.22 | 13.62 | 1.14 | 0.25 | 15.02 | 31.41 | 2.91 |
| Fly dust | 83.5 | 21.68 | 27.53 | 17.43 | 4.67 | 4.88 | — | 25.99 | 2.40 |
| Fly dust (b) | 100.5 | 18.01 | 22.87 | 14.48 | 3.88 | 7.45 | 23.38 | 21.60 | 2.00 |
| Conversion process | | | | | | | | | |
| Feed matte: I + II | 384.0 | 54.52 | 26.51 | — | 0.98 | 17.17 | 0.49 | 0.10 | — |
| Raw Copper | 207.4 | 97.55 | 0.34 | — | 1.32 | 0.65 | 0.01 | — | — |
| Slag - II | 197.0 | 3.57 | 51.56 | 8.97 | 0.52 | 1.01 | 16.14 | 25.13 | 1.46 |
| Slag reduction process | | | | | | | | | |
| Feed slag: I + II | 1007.0 | 5.88 | 44.04 | 12.71 | 1.02 | 0.40 | 15.24 | 30.18 | 2.62 |
| Matte - II | 190.0 | 29.21 | 53.14 | — | 1.51 | 15.09 | 0.58 | — | — |
| Waste slag | 917.0 | 0.40 | 47.06 | 3.36 | 0.80 | 1.46 | (13.49) | 33.14 | 2.88 |

TABLE 31.

| Common practice. Heat balance | | | | | | |
|---|---|---|---|---|---|---|
| | Reaction shaft balance | | | Lower furnace balance | | |
| Heat balance component | Material amount ton/$Nm^3$ | Temperature °C. | Heat amount Mcal | Material amount ton/$Nm^3$ | Temperature °C. | Heat amount Mcal |
| In | | | | | | |
| Feed mixture | 19.45 | 25 | 14340 | | | |

TABLE 31.-continued

| Common practice. Heat balance | | | | | | |
|---|---|---|---|---|---|---|
| Shaft product | | | | 16.61 | 1350 | 4750 |
| Gas phase | | | | 15770 | 1350 | 8090 |
| Oil | | | | 0.55 | 25 | 5330 |
| Air | 17000 | 25 | — | 4815 | 25 | — |
| In together | | | 14340 | | | 18170 |
| Out | | | | | | |
| Shaft product | 16.61 | 1350 | 4750 | | | |
| Matte | | | | 2.91 | 1250 | 2170 |
| Slag | | | | 12.15 | 1300 | 4100 |
| Fly dust | | | | 1.25 | 1300 | 310 |
| Gas phase | 15770 | 1350 | 8090 | 21000 | 1300 | 10460 |
| Heat losses | | | 1500 | | | 1100 |
| Out together | | | 14340 | | | 18140 |

| Heat balance component | Conversion balance: Material amount ton/Nm³ | Temperature °C. | Heat amount Mcal | Slag reduction furnace balance: Material amount ton/Nm³ | Temperature °C. | Heat amount Mcal |
|---|---|---|---|---|---|---|
| In | | | | | | |
| Matte | 5.76 | 1250 | 5480 | | | |
| Slag | | | | 15.11 | 1300 | 5120 |
| Sand | 0.80 | 25 | −10 | | | |
| Copperscrap | 3.56 | 25 | — | | | |
| Iron sulfide | | | | 2.29 | 25 | 2830 |
| Coke | | | | 0.17 | 25 | 1120 |
| Added energy | | | | | | |
| Air | 3230 | 25 | — | | | |
| In together | | | 5470 | | | 11640 |
| Out | | | | | | |
| Raw copper | 3.11 | 1250 | 1640 | | | |
| Matte | | | | 2.85 | 1250 | 3320 |
| Slag | 2.96 | 1300 | 1020 | 13.76 | 1300 | 6440 |
| Scrap | 3.56 | 1250 | 640 | | | |
| Gas phase | 2920 | 1300 | 1460 | 410 | 1300 | 980 |
| Heat losses | | | 700 | | | 900 |
| Out together | | | 5460 | | | 11640 |

TABLE 4.

| Material component | Method in accordance with the invention. Material balance: Amount kg | Analysis, weight - %: Ni | Co | Cu | Fe | Fe+8 | S | O | $SiO_2$ | $O_x$ |
|---|---|---|---|---|---|---|---|---|---|---|
| Shaft oxidation process | | | | | | | | | | |
| Feed mixture | 1330.0 | 5.90 | 0.17 | 2.59 | 33.42 | 1.17 | 23.12 | 2.40 | 22.98 | 7.76 |
| Shaft product | 1180.0 | 6.64 | 0.19 | 2.91 | 37.67 | 16.58 | 2.44 | 13.40 | 25.90 | 8.74 |
| Matte | 52.0 | 41.77 | 0.04 | 30.27 | 3.78 | — | 23.48 | 0.29 | — | — |
| Slag | 945.0 | 4.67 | 0.19 | 1.36 | 40.43 | 9.63 | 0.16 | 14.21 | 29.46 | 8.15 |
| Metallization zone | | | | | | | | | | |
| Shaft product | 1188.5 | 6.60 | 0.19 | 2.89 | 37.40 | 15.04 | 4.47 | 12.54 | 25.72 | 8.68 |
| Matte | 113.0 | 50.37 | 0.33 | 21.44 | 3.24 | — | 24.32 | 0.29 | — | — |
| Slag | 898.0 | 1.12 | 0.17 | 0.55 | 42.97 | 4.68 | 0.45 | 13.11 | 31.26 | 8.84 |
| Fine matte | 102.6 | 64.27 | 0.93 | 27.76 | 0.35 | — | 6.55 | — | — | — |
| Slag | 915.0 | 1.15 | 0.17 | 0.56 | 44.90 | 4.74 | 0.47 | 13.27 | 30.68 | 8.67 |
| Fly dust | 75.0 | 7.63 | 0.22 | 3.50 | 36.65 | 16.28 | 3.66 | 12.90 | 16.58 | 15.85 |
| Slag reduction process | | | | | | | | | | |
| Matte | 26.5 | 35.75 | 2.38 | 16.89 | 33.96 | — | 9.81 | — | — | — |
| Slag | 895.0 | 0.11 | 0.10 | 0.07 | 44.53 | 1.11 | 0.80 | 12.59 | 31.37 | 8.87 |

TABLE 41.

| Heat balance component | Method in accordance with the invention. Heat balance: Reaction shaft: oxydation balance: Material amount ton/Nm³ | Temperature °C. | Heat amount Mcal | Reaction shaft and lower furnace balance: Material amount ton/Nm³ | Temperature °C. | Heat amount Mcal |
|---|---|---|---|---|---|---|
| In | | | | | | |
| Feed mixture | 15.96 | 25 | 11940 | | | |
| Shaft product | | | | 15.06 | 1400 | 3720 |
| Gas phase | | | | 12760 | 1400 | 6820 |
| Pyrite | | | | 0.22 | 25 | 280 |
| Coke | | | | 0.07 | 25 | 510 |
| Gasoline | | | | 0.18 | 25 | 2020 |
| Added energy | | | | | | 2230 |
| Air | 13750 | 25 | — | 470 | 25 | — |
| In together | | | 11940 | | | 15580 |
| Out | | | | | | |
| Shaft product | 15.06 | 1400 | 3720 | | | |
| Gas phase | 12760 | 1400 | 6820 | 13740 | 1300 | 7880 |
| Fine matte | | | | 1.23 | 1300 | 1300 |

TABLE 41.-continued

| Heat balance component | Method in accordance with the invention. Heat balance: Reaction shaft: oxydation balance: Material amount ton/Nm³ | Temperature °C. | Heat amount Mcal | Reaction shaft and lower furnace balance: Material amount ton/Nm³ | Temperature °C. | Heat amount Mcal |
|---|---|---|---|---|---|---|
| Waste slag | | | | 10.74 | 1300 | 4200 |
| Fly dust | | | | 0.90 | 1300 | 290 |
| Heat losses | | | 1400 | | | 1900 |
| Out together | | | 11940 | | | 15570 |

TABLE 5.

| Matte-slag and metal-slag system | The Nernst distribution of product phase: Temperature °C. | $P_{O_2}$ atm | Nernst distribution, H: Cu | Ni | Co | Zn |
|---|---|---|---|---|---|---|
| Method in acc. with the invention: Cu | | | | | | |
| Shaft oxidation: matte/slag | 1350 | $9.53 \times 10^{-7}$ | 26.1 | 18.2 | 4.24 | 0.40 |
| Shaft reduction: matte/slag | 1300 | $3.03 \times 10^{-8}$ | 45.8 | 25.6 | 4.49 | 0.40 |
| Metallization: matte/slag | 1300 | — | 45.0 | 19.6 | 5.53 | 0.34 |
| : metal/matte | 1250 | $(2.50 \times 10^{-8})$ | 1.24 | 1.20 | 0.74 | 0.78 |
| Slag reduction: matte/slag | 1300 | $2.16 \times 10^{-9}$ | 75.4 | 43.48 | 4.48 | 2.28 |
| Common practice: Cu | | | | | | |
| LS-process: matte/slag | 1300 | $1.29 \times 10^{-5}$ | 12.3 | 2.77 | 0.36 | 0.15 |
| Conversion: metal/slag | 1250 | $4.17 \times 10^{-8}$ | 27.3 | 14.0 | 1.77 | 1.55 |
| Slag reduction: matte/slag | 1300 | $2.01 \times 10^{-9}$ | 72.7 | 32.5 | 2.28 | 1.14 |
| Method in acc. with the invention: Ni | | | | | | |
| Shaft oxidation: matte/slag | 1350 | $3.05 \times 10^{-6}$ | 22.3 | 3.94 | 0.21 | — |
| Shaft reduction: matte/slag | 1300 | $1.39 \times 10^{-8}$ | 39.0 | 45.0 | 1.94 | — |
| Metallization: fine matte/slag | 1300 | $(1.22 \times 10^{-8})$ | 49.6 | 55.9 | 5.47 | — |
| Slag reduction: matte/slag | 1300 | $1.46 \times 10^{-11}$ | 233 | 314 | 22.9 | — |

What is claimed is:

1. A suspension smelting furnace for the suspension smelting of a finely divided material selected from at least one of the group comprising oxide and sulfide ores and concentrates, especially iron-rich copper and nickel concentrates, and comprising a horizontal lower furnace, to which the lower ends of at least one vertical reaction shaft and at least one rising shaft are connected, a lower portion of said reaction shaft encompassing a suspension reduction zone and an upper portion of said reaction shaft encompassing a suspension oxidation zone above said suspension reduction zone, and means at an upper end of the suspension oxidation zone for producing a suspension of a feed mixture containing the finely-devided material with gas and for directing a suspension of the finely divided material and gas downwards in and through the suspension oxidation and the suspension reduction zones, devices located at the lower end of the suspension reduction zone for sulfidizing or reducing the suspension, a melt reduction zone within the lower furnace under the suspension reduction zone into which most of the suspension is discharged, and devices in the rising shaft for withdrawing any remaining suspension from upper part of the rising shaft; means for injecting an oxidizing gas horizontally into a matte phase under a slag layer in a melt reaction zone in the lower furnace below the lower end of the reaction shaft in order to produce raw metal from valuable metals present in the melt; and means for withdrawing such raw metal and waste slag from the lower furnace.

2. The suspension smelting furnace of claim 1, the devices for injecting the oxidizing gas comprising at least one nozzle fitted in the lower furnace and directed downwards, its upper end communicating with a source of oxidizing gas outside the furnace and its lower end being adapted to blow the oxidizing gas substantially horizontally into the matte phase.

* * * * *

UNITED STATES PATENT AND TRADEMARK OFFICE

CERTIFICATE OF CORRECTION

PATENT NO. : 4,236,700

DATED : December 2, 1980

INVENTOR(S) : Simo A. I. Makipirtti et al

It is certified that error appears in the above-identified patent and that said Letters Patent are hereby corrected as shown below:

Column 3, line 38:

first word "impining" should be --impinging--

Column 4, line 21:

"magnetic" should be --magnetite--

Column 4, line 49:

"copper rate" should be --copper matte--

Column 7, line 23:

"whichis" should be --which is--

Column 18, line 50:

"29.2%" should be --29.9%--

Columns 23, 24 - Table 31:

Column beginning "Coke", last column, the figures --2570-- are omitted

Signed and Sealed this

*Sixteenth* Day of *June 1981*

[SEAL]

*Attest:*

RENE D. TEGTMEYER

*Attesting Officer*

*Acting Commissioner of Patents and Trademarks*